United States Patent [19]

Watson

[11] Patent Number: 4,777,477

[45] Date of Patent: Oct. 11, 1988

[54] SURVEILLANCE ALARM-SECURITY SYSTEM

[76] Inventor: Ronald R. Watson, 7716 E. Lewis, Scottsdale, Ariz. 85257

[21] Appl. No.: 42,835

[22] Filed: Apr. 27, 1987

[51] Int. Cl.[4] ..... G08B 23/00

[52] U.S. Cl. ..... 340/573; 73/773; 340/668

[58] Field of Search ..... 340/573, 539, 668, 574; 73/773, 786; 128/782

[56] References Cited

U.S. PATENT DOCUMENTS 3,478,344 11/1969 Schwitzgebel et al. ..... 340/539 X 4,287,511 9/1981 Scott et al. ..... 340/541

4,392,126 7/1983 Loyola ..... 340/573

4,598,275 7/1986 Ross et al. ..... 340/573

*Primary Examiner*—Glen R. Swann, III

*Assistant Examiner*—Thomas J. Mullen, Jr.

*Attorney, Agent, or Firm*—Nissle & Leeds

[57] ABSTRACT

An alarm-security system for maintaining surveillance of an individual. When unauthorized departure of an individual from a defined secure area is detected, the alarm-security system generates departure signals which are transmitted to a control center where alarm signals are initiated. In one embodiment of the system an alarm-secure band is carried on the person and cannot be removed from the person without generating alarm signals.

2 Claims, 1 Drawing Sheet

LEGEND:

R1, R2 & R3 ——— 22KΩ

R4 & R5 ——— 1 MEGΩ

C1, C2 & C3 ——— 47 PICOFARADS

LEGEND:

R1, R2 & R3 _____ 22KΩ

R4 & R5 _____ 1 MEGΩ

C1, C2 & C3 _____ 47 PICOFARADS

SURVEILLANCE ALARM-SECURITY SYSTEM

This invention relates to surveillance alarm-security systems for detecting the unauthorized departure of a person from a defined secure area in a building structure.

More particularly, the invention relates to surveillance alarm-security systems which, when unauthorized departure of an individual from a defined secure area is detected, generate departure signals which are transmitted to a control center where the alarm signals are initiated.

In another respect, the invention relates to surveillance alarm-security systems of the type described in which an alarm-secure band is carried on the person and cannot be removed from the individual without generating alarm signals.

In a further respect, the invention relates to surveillance alarm-security apparatus in which structural moment detectors generate alarm signals when an individual departs a defined secure area in a building structure.

The monitoring and surveillance of parolees after they are released from prison is an important and difficult task. Such surveillance of parolees is crucial, both in the rehabilitation of the parolee and in the protection of members of the public at large from further criminal acts by parolees who regress after being releaed from prison. Currently, the activities of parolees are monitored by having parole officers periodically travel to and physically inspect the living quarters of a parolee to insure that the parolee is remaining within his defined geographical area and to insure that the parolee is regularly reporting to work and returning home on completion of work. Such conventional procedures for monitoring the activities of a parolee are time consuming and expensive, and, because of the limited manpower available to various state parole agencies, are usually ineffective in accurately monitoring the activities of a parolee.

Accordingly, it would be highly desirable to provide an improved system for monitoring the activities of a parolee which would generally not require on-site physical inspection of a parolee's living quarters and would accurately monitor the job activities and location of a parolee while requiring a minimal amount of parole agency manpower.

Therefore, it is a principal object of the invention to provide an improved method and surveillance alarm-security system for detecting the unauthorized departure of a person from a defined secure area in a building structure.

A further object of the invention is to provide an improved surveillance alarm-security system which permits the unauthorized departure of a person from a defined secure area in a building structure to be readily detected without requiring the presence of a parole agent at the building structure.

Another object of the invention is to provide an improved surveillance alarm-security system for detecting the unauthorized departure of a person from a defined secure area in a building structure or out-of-doors area, the system including an alarm-secure band carried on the person for generating and transmitting a secure signal and for, when the band is removed from the person, generating and transmitting an alarm signal.

These and other, further and more specific objects and advantages of the invention will be apparent to those of skill in the art from the following detailed description thereof, taken in conjunction with the drawings, in which.

Briefly, in accordance with my invention, I provide an improved surveillance alarm-security system for detecting the unauthorized departure of a person from a defined secure area in a building structure, and for generating and transmitting signals responsive to such departure. The surveillance alarm-security system includes an alarm-secure band carried on the person and including at least one loop around a portion of the body of the person, means for generating a secure signal, and means for generating an alarm signal responsive to removal of the band from the person; means carried on the person for transmitting the secure and alarm signals; and, means in the building structure for receiving the secure and alarm signals and for generating security system activation signals in response thereto. The alarm signal means can comprise electrical circuitry connected to the loop and responsive to severing of the loop induced by removal of the band from the person to generate the alarm signal. The alarm signal means can also comprise at least one structural moment detector, the structural moment detector generating signals responsive to deflection of the band induced by the removal of the band from the person and being insensitive to linear distortion of the band. The alarm signal means can further comprise strain gauge means, the strain gauge means generating signals responsive to linear distortion of the band induced by the removal of the band from the person.

In accordance with another embodiment of my invention, I provide an improved surveillance alarm-security system for detecting the unauthorized departure of a person from a defined secure area in a building structure, for generating and transmitting signals responsive to such departure, and for activating security systems in response to such departure. The alarm-security system comprises at least one structural moment detector carried by a structural member of the building structure located in a secure area, the structural moment detector generating departure signals responsive to deflection of the structural member induced by changes of loading on the member caused by the departure of the person from the secure area and being insensitive to linear distortion of the member; means for transmitting the departure signals to a control center; and, means in the control center for receiving the departure signals and for generating security system activation signals in response thereto.

Figure 1:
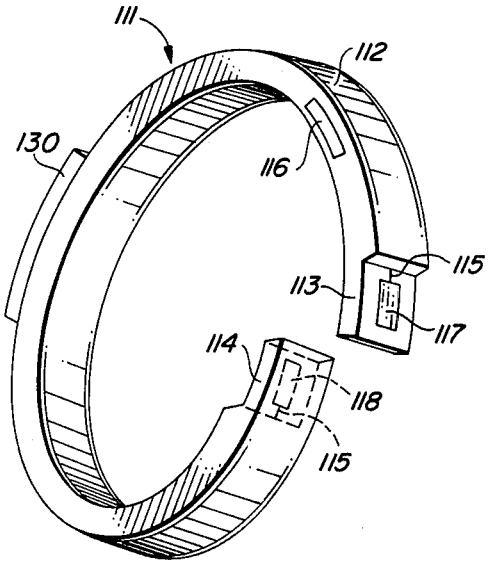
FIG. 1 is a perspective view of a wristband constructed in accordance with the principles of the surveillance alarm-security system of the invention.
Figure 2:
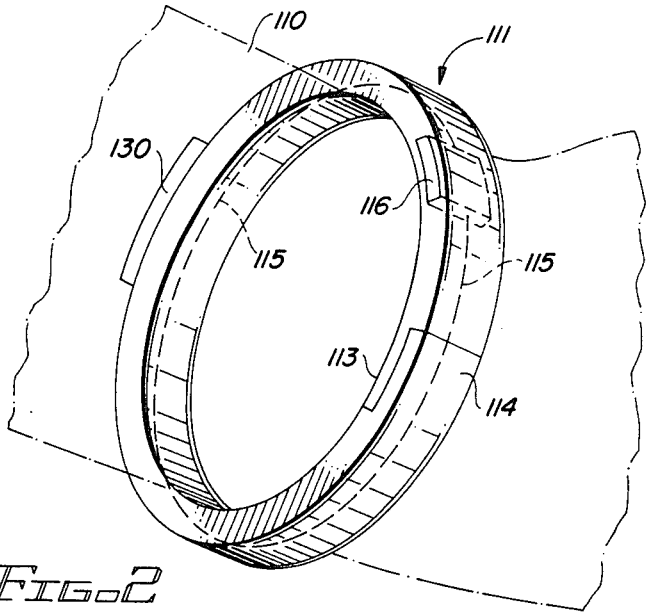
FIG. 2 is a perspective view of the wristband of FIG. 1, without the SMD, fixedly installed on the arm of a person.
Figure 3:
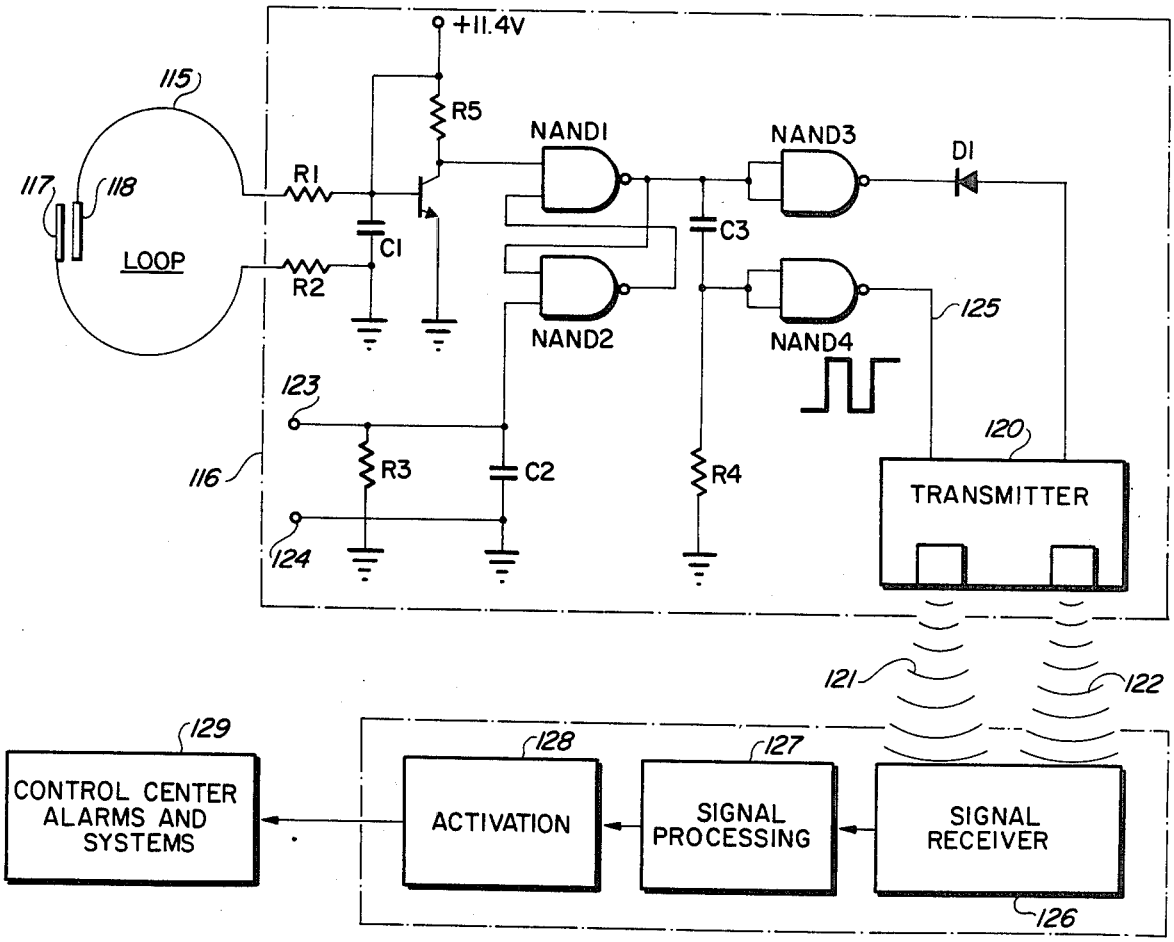
FIG. 3 is a schematic diagram of a surveillance alarm-security system constructed in accordance with the principles of the invention.

Turning now to the drawings, which depict the presently preferred embodiments and best mode of the invention for the purpose of illustrating the practice thereof and not by way of limitation of the scope of the invention, and in which identical reference characters represent corresponding elements throughout the several views, FIGS. 1 to 3 illustrate the presently preferred embodiment and best mode of the invention, including an alarm-secure band generally indicated by reference character 111. Band 111 is sized to securely fit around the wrist 110 or other portion of the body of a person. Band 111 includes elongate plastic strap 112 with interfitting ends 113 and 114. Loop 115 of electrically conductive metal wire or other material extends partially or completely around wrist 110. The ends of loop 115 are connected to controller-transmitter circuitry 116. Electrical contacts 117 and 118 contact each other when ends 113 and 114 are glued together or otherwise fixedly attached in the manner illustrated in FIG. 2. A structural moment detector (SMD) 130 can be mounted on strap 112 in the manner indicated in FIG. 1 to indicate when the strap 112 is removed from a person.

In the controller-transmitter circuitry 116 illustrated in FIG. 3, transmitter 120 can send a secure signal 121 or alarm signal 122. If loop 115 is cut, transistor Q1 is turned on because the base of the transistor, which is normally held low, is pulled high when the loop is cut. When transistor Q1 is turned on, NAND1 and NAND2 gates flip flop or latch, to latch the alarm line 125 leading to transmitter 120. If after loop 115 is cut, loop 115 is reconnected, the NAND1 and NAND2 gates remain latched until reset connectors 123 and 124 are shorted out by putting a screwdriver across terminals 123 and 124. The controller-transmitter circuitry 116 is sealed. Even if the person wearing alarm-secure band 111 manages to break into circuitry 116, he is not able to readily identify the reset contacts 123, 124.

When the person wearing alarm-secure band 111 is in a defined secure area either in a building structure or out-of-doors and adjacent the structure, transmitter 120 continuously or at selected intervals sends a secure RF signal 121 to a signal receiver 126 in the building structure. When receiver 126 is receiving secure signal 121 from transmitter 120, the signal is processed 127 and an activation signal 128 is sent to a control center alarms and systems location 129, either continuously or on a periodic basis. If desired, when receiver 126 is receiving a secure signal 121 from transmitter 120, receiver 126 need not send a signal to control center alarms and systems 129.

Transmitter 120 has a limited range such that when a person leaves a defined secure area comprising a building structure and/or out-of-doors area outside the building structure, receiver 126 can not detect signal 121. When receier 126 fails to receive signal 121, an activation "maintenance" signal 128 is sent to control center alarms and systems 129 to show that transmitter 120 is out of range or is not functioning. If loop 115 is cut or otherwise severed, when receiver 126 receives alarm signal 122, an activation alarm signal 128 is sent to control center alarms and systems 129.

Receiver 126, signal processing 127 and activation 128 can, as would be appreciated by those of skill in the art, be modified such that an activation "maintenance" signal is transmitted to control center alarms and systems 129 if a person does not leave or return to the defined secure area before, during, or after certain selected times of day.

The transmitter 120 presently utilized is a Model 7302 transmitter produced by Sentrol, Inc. of 10831 S. W. Cascade Blvd., Portland, Oreg. 98223. The receiver 126 is a Model 7001 receiver, also produced by Sentrol Inc. of Portland, Oreg.

Under certain circumstances, it might be possible for a person wearing band 111, by slightly stretching and lengthening the band 111, to slide the band off of the wrist and over the hand. Strain gauge means carried on band 112 would detect such a stretching of strap 112. Such strain gauge means would be connected to transmitter 120 and cause transmitter 120 to send a secure signal 121 while alarm-secure band 111 was being normally worn and would cause transmitter 120 to send an alarm signal 122 when the strain gauge means detected stretching of strap 112.

A structural moment detector (SMD) can be carried on strap 112 to detect undue deflection of strap 112 from the orientation thereof shown in FIG. 2, for instance when strap 112 is cut and removed from the person. As will be described, structural moment detectors can also be attached to structural members in the secure area of a building structure to indicate when a person leaves the secure area.

Figure 5:
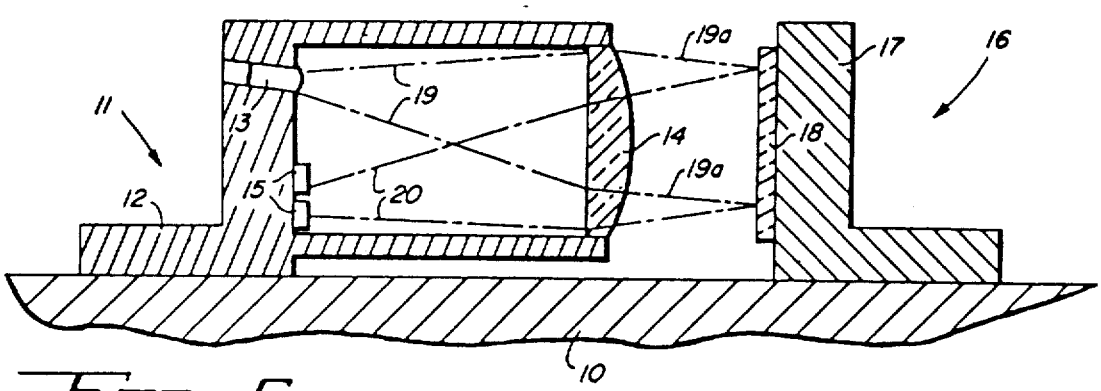
FIG. 5 is a section view of a structural moment detector which serves as the departure sensor according to preferred embodiments of the invention.

As used herein, the term "structural moment detector" means a device which measures the integral of the moment between two points on the building structure or on band 111. Such devices are known in the art, but for clarity will be briefly described in FIGS. 5 to 7 and the accompanying descriptive material. The structural moment detector is basically an autocollimator that is insensitive to linear dynamic motions but respond to angular deflection of one end of the sensor with respect to the other. Referring to FIG. 5, the structural moment detector consists of two separate parts which are mounted at spaced locations on a beam or other structural member 10. One of the parts 11 is a support bracket 12 which carries a light-emitting diode (LED) 13, a collimating lens 14 and dual photovoltaic detectors 15. The other part 16 of the structural moment detector consists of a support bracket 17 which carries a planar front mirror 18. The two parts 11 and 16 are suitably joined by a bellow or other hood member (omitted for clarity of illustration) to exclude extraneous light. The LED 13 emits an infrared light beam 19 which is collimated by the collimating lens 14. The collimated light beam **19*a* impinges on the mirror 18 and, as indicated by the dashed lines 20, is reflected back through the collimating lens 14 to the photovoltaic cells 15. Angular motions, but not linear motions, of the mirror 18 result in varying amounts of infrared radiation reaching each of the photovoltaic cells 15. The difference in voltage output of the photovoltaic cells 15 is then proportional to the angular motion of the mirror 18 with respect to the cells 15**.

When mounted on structural building components such as floor, ceiling or wall beams, or when mounted on other structural components such as strap 112, such structural moment detectors can measure the deflection of the component with a resolution of 1 milliarc second ($10^{-9}$ radians) with a range of plus or minus ten arc seconds. Where such accuracy is not required, such devices can be fabricated which have a resolution of at least one arc second with a dynamic range of plus or minus three degrees. Such devices are capable of operating from DC to 50 KHz, the upper limit being established by the frequency limitation of the photovoltaic cells.

Figure 6:
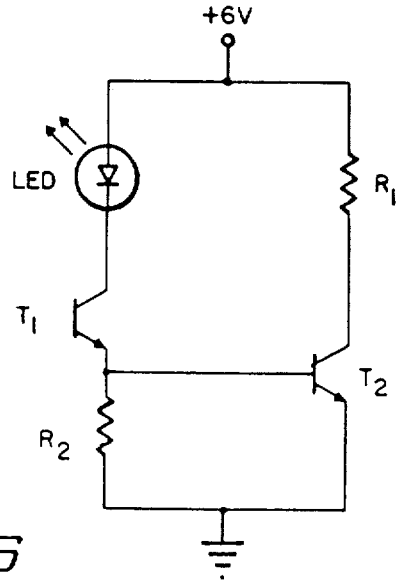
FIG. 6 is a schematic of the LED driver circuit of the structural moment detector of FIG. 5; and, FIG. 7 is a schematic of the readout electronics circuit of the structural moment detector of FIG. 5.
Figure 7:
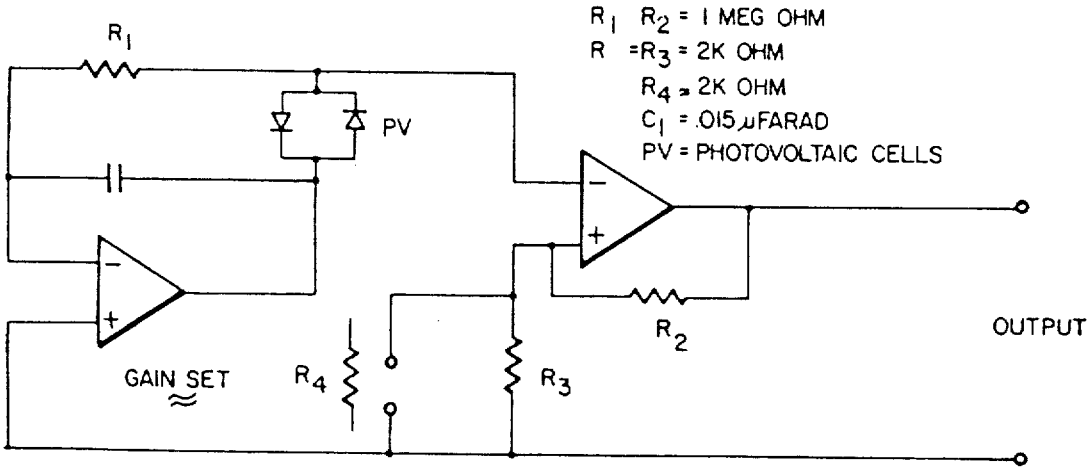

Typical circuits which are used in conjunction with the mechanical components of the structural moment detector of FIG. 5 are illustrated in FIGS. 6 and 7. FIG. 6 is a schematic diagram of a suitable LED driver circuit which is required to provide a light source with constant light intensity. A typical suitable readout circuit is illustrated in FIG. 7, which depicts an analog output circuit consisting of a first stage self-nulling amplifier with common mode rejection and a second stage operational amplifier with relatively high gain.

Since it is impossible to load a structure without changing the total moment which occurs between two points on the structure, it is possible to use the structural moment detector as an extremely accurate and extremely sensitive sensor having a range which far exceeds that of many other conventional detectors.

Furthermore, the output of a structural moment detector can be converted by any appropriate transducer such as an electrically actuated tapper or a capacitive loader to securely transmit signals through the building structure, itself, to a central control point and to transmit signals back to a secure area from the control point to activate security system components, such as automatic door locking mechanisms, lights, audible alarms, disabling gas injecting systems, etc.

Figure 4:
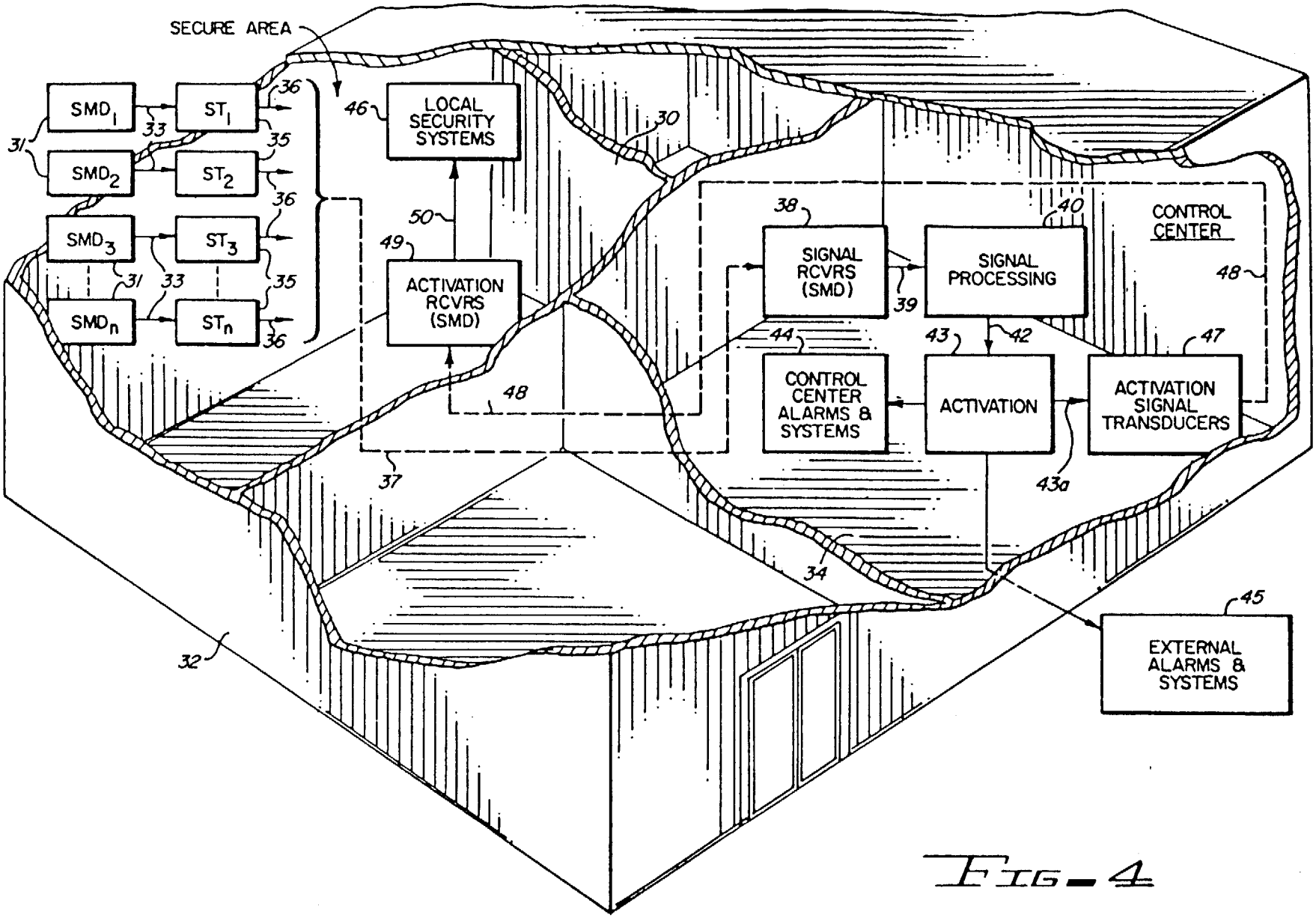
FIG. 4 is a schematic diagram illustrating the operation of departure alarm systems embodying the present invention.

The operation and location of components of a surveillance alarm-security system incorporating the principles of the present invention and various preferred embodiments thereof are schematically depicted by FIG. 4. As shown, a secure area 30 may contain a plurality of structural moment detectors (SMD's) 31 attached to various structural components of the building structure 32. The electrical outputs 33 of the SMD's 31 are supplied to transducers 35 which convert the electrical intrusion signals 33 to mechanical forces 36 which are applied directly to the building structure and the resultant mechanical signals 37 are transmitted through the building structure 32 to the control center 34 where they are received by one or more SMD's 38 which produce secondary intrusion signals 39 which are transmitted to appropriate signal processing equipment 40.

The signal processing equipment 40 processes the secondary signal 39 in accordance with art-recognized techniques to reject spurious signals and to perform other signal-processing steps, such as time-of-departure analysis to indicate the point of departure, comparison of the footprint "signature" of the person departing with the footprint signatures of authorized personnel to determine whether the departure is authorized, etc. Upon identification of secondary intrusion signals 39 as legitimate and unauthorized, the signal-processing equipment generates alarm signals 42 which are transmitted to alarm-activation equipment 43. The alarm-activation equipment activates various control center alarms and systems 44, various external alarms and systems 45 and various local security systems 46 located in the secure area 30. The activation signals **43*a* from the alarm activation equipment 43 can be transmitted electrically, directly to the local security system 46 in the secure area 30 according to conventional prior art techniques. However, in accordance with a presently preferred embodiment of the invention, the activation signals 43*a* are applied to appropriate transducers 47 and converted to mechanical forces which are applied to the building structure 32 and transmitted therethrough as mechanical activation signals 48 which are received by activation signal receivers (SMD's) 49 located within the secure area 30, the output 50 of which is transmitted to and activates the local security systems 46 in the secure area 30**.

As will be appreciated by those skilled in the art, the use of structural moment detectors as departure sensors provides significant advantages. Additionally, by coupling the sensors and the control center with transducers and additional structural moment detector devices, the departure signals and activation signals can be transmitted between the system components without the necessity of wires or an electronic field.

Alarm-secure band 111 can be equipped with electronica circuitry which measures the electrical resistance of loop 115. If loop 115 is severed, or a jumper wire is, prior to cutting loop 115, attached to loop 115, the resistance-detection circuitry determines that there has been a change in the electrical resistance of loop 115 and, via transmitter 120 and receiver 126, causes an alarm signal at control center alarms 129 to be activated.

Having described my invention in such terms as to enable those skilled in the art to understand and practice it, and having identified the presently preferred embodiments thereof, I claim:

1. A surveillance alarm-security system for detecting unauthorized departure of a person from a defined secure area in a building structure, for generating and transmitting signals responsive to such departure, and for activating security systems in response to such departure, said system comprising a. an alarm-secure band carried on the person and including
   (i) at least one loop around a portion of the body of the person,
   (ii) means for generating a secure signal, and
   (iii) means for generating an alarm signal responsive to removal of said band from the person;
b. means carried on the person for transmitting said secure and alarm signals; and,
c. means in said building structure for receiving said secure and alarm signals and for generating security system activation signals in response thereto;

said alarm signal means comprising at least one structural moment detector, said structural moment detector generating signals responsive to deflection of said band induced by the removal of said band from the person and being insensitive to linear distortion of said band.

2. A surveillance alarm-security system for detecting unauthorized departure of a person from a defined secure area in a building structure, for generating and transmitting signals response to such departure, and for activating security systems in response to such departure, said system comprising a. an alarm-secure band carried on the person and including
   (i) at least one loop around a portion of the body of the person,
   (ii) means for generating a secure signal, and
   (iii) means for generating an alarm signal responsive to removal of said band from the person;
b. means carried on the person for transmitting said secure and alarm signals; and,
c. means in said building structure for receiving said secure and alarm signals and for generating security system activation signals in response thereto;

said alarm signal means comprising strain gauge means, said strain gauge means generating signals responsive to linear distortion of said band induced by the removal of said band from said person.

* * * * *

UNITED STATES PATENT AND TRADEMARK OFFICE

CERTIFICATE OF CORRECTION

PATENT NO. : 4,777,477

DATED : October 11, 1988

INVENTOR(S) : Ronald R. Watson

It is certified that error appears in the above-identified patent and that said Letters Patent is hereby corrected as shown below:

Figs. 4 to 7 of the drawings were omitted and are attached as shown on the following sheets.

Signed and Sealed this

Eighth Day of August, 1989

*Attest:*

DONALD J. QUIGG

*Attesting Officer*

*Commissioner of Patents and Trademarks*

$R_1$ = 4990 OHM
$R_2$ = 20 OHM
$T_1$ = $T_2$ = 2N2222
OR EQUIVALANT
LED = LIGHT EMITTING DIODE $R_1$ $R_2$ = 1 MEG OHM
R = $R_3$ = 2K OHM
$R_4$ = 2K OHM
$C_1$ = .015 μFARAD
PV = PHOTOVOLTAIC CELLS